United States Patent [19]

De Keijzer

[11] Patent Number: 4,458,174

[45] Date of Patent: Jul. 3, 1984

[54] COLOR DISPLAY TUBE

[75] Inventor: Abraham A. De Keijzer, Eindhoven, Netherlands

[73] Assignee: U.S. Philips Corporation, New York, N.Y.

[21] Appl. No.: 154,631

[22] Filed: May 30, 1980

[30] Foreign Application Priority Data

Jun. 14, 1969 [NL] Netherlands ..... 7904653

[51] Int. Cl.[3] ..... H01J 29/07

[52] U.S. Cl. ..... 313/402; 313/403

[58] Field of Search ..... 313/403, 402

[56] References Cited

U.S. PATENT DOCUMENTS

| | | | |
|---|---|---|---|
| 2,916,649 | 12/1959 | Levin | 313/250 |
| 4,107,569 | 8/1978 | Ronde | 313/402 |
| 4,121,131 | 10/1978 | Esdonk et al. | 313/403 X |
| 4,207,490 | 6/1980 | Ven | 313/403 |

*Primary Examiner*—Robert Segal

*Attorney, Agent, or Firm*—Joseph P. Abate

[57] ABSTRACT

A color display tube comprises, in an evacuated envelope, means for generating a number of electron beams, a display screen comprising a large number of regions luminescing in different colors when struck by the beams, and color selection means for associating each electron beam with luminescent regions of one color. The color selection means includes a plurality of conductive strips and a metal plate having a plurality of parallel apertured rows. The plate, between the apertured rows, and the strips, in the sides facing the plate, have grooves extending in the longitudinal direction of the strips. The strips are accurately positioned between the rows by insulating carriers secured in respective grooves by adhesive materials. Each carrier engages its respective grooves in only two locations per groove. The adhesive material, at least in the grooves of the strips, is an electrically conductive adhesive.

8 Claims, 8 Drawing Figures

COLOR DISPLAY TUBE

BACKGROUND OF THE INVENTION

The invention relates to a color display tube comprising, in an evacuated envelope, means for generating a number of electron beams, a display screen having a large number of areas luminescing in different colors when struck by the beams, and color selection means for associating each electron beam with luminescent regions of one color. The color selection means comprises a metal plate which is provided with rows of apertures and which forms a first set of lens electrodes to which, between the rows, spherical or rod-shaped insulating carriers are fixed by an adhesive, to which carriers, elongate conductors are secured which constitute a second set of lens electrodes. Between the sets, a potential difference is applied.

Such a color display tube is disclosed in Netherlands Patent Application No. 7600420 laid open to public inspection. By applying a potential difference between the elongate conductors and the metal plate, the apertures form electrostatic quadrupole lenses each having an electric field which is perpendicular or substantially perpendicular to the electron beams passing through the apertures. The lenses focus the electron beams in one direction and defocus them in the direction extending at right angles thereto. The color selection occurs analogous to color display tubes without post-focusing. As a result of post-focusing, however, the apertures may be much larger than in tubes without post-focusing so that a greater number of electrons impinges upon the display screen. As a result, a much brighter or sharper picture can be obtained because sufficient brightness is possible with a smaller electron beam current. In fact, with a smaller beam current, a small spot is possible substantially without a haze surrounding the spot. Such a color display tube is described elaborately in U.S. Pat. No. 4,059,781 which is considered incorporated by reference.

Netherlands Patent Application No. 7600420 laid open to public inspection discloses a color display tube in which the metal plate, at least between the rows of apertures, is provided with a layer of adhesive material, for example, consisting of the polyamide of 4-4′ diaminodiphenyl ether and 1-2-4-5 benzenetetracarboxylic acid dianhydride, of methylmethacrylate resin or of sealing glasses or polymers. On their sides facing the plate, the elongate conductors are also covered with such a layer of adhesive material. The elongate conductors are kept at a defined distance from the plate by grains of an electrically insulating material. The grains are sunk partly in the layer of adhesive material present on the plate and partly in the layer of adhesive material present on the elongate conductors. Such a construction has the disadvantage that, in the case of color selection means of large dimensions (having a diagonal exceeding 35 cm), it is difficult to position the elongate conductors accurately between the rows of apertures in the plate without color defects arising in the picture.

U.S. Pat. No. 2,916,649 discloses a construction for the accurate positioning of a number of electrodes relative to each other in travelling wave guides. The electrodes comprise pits, holes or channels obtained by deep drawing in which spacer elements of insulation material are placed. In color selection means for display tubes as hereinbefore described, such a construction cannot be used. 300,000 holes or pits would be necessary in the color selection means. Moreover, positioning two electrodes relative to each other by means of holes or pits is not unambiguous. The spacer elements will always engage in the holes or pits in a different manner. Providing channels by means of deep drawing is also not desired since this makes the color selection means much less rigid in one direction. Moreover, sharp edges are formed in such channels which might give rise to flashover between the elongate conductors and the plate if they were used in the color selection means. The distance between the conductors and the apertured metal plate in such color selection means is, in fact, 100 μm and the potential difference is approximately 2000 Volts.

Netherlands Patent Application No. 7600422 laid open to public inspection discloses a color display tube in which elongate conductors are positioned between rows of apertures in a metal plate and are each kept at a defined place by at least one insulating member. The member consists of a core which determines the distance between the elongate conductors and the plate and a jacket which is adhered directly to the elongate conductors and the plate. The core consists of a material having a melting point higher than the jacket material. The core consists, for example, of a glass fiber and is surrounded by a jacket of glass having a melting point lower than the glass fiber. This construction also has the disadvantage that, in shadow masks of large dimensions, it is difficult to position the elongate conductors accurately between the rows of apertures in the metal plate. A very accurate positioning is necessary in order to obtain a pure picture.

SUMMARY OF THE INVENTION

It is therefore an object of the invention to provide an arrangement in which the elongate conductors are positioned very accurately and simply between the rows of apertures in the metal plate without flashovers occurring between the elongate conductors and the plate when high voltages are applied.

A color display tube, in accordance with the invention is characterized in that grooves are present both in the metal plate in the spaces between the substantially parallel rows of apertures, and the elongate conductors, in the longitudinal extending direction of said conductors, in which grooves the carriers are unambiguously centered and secured. Per carrier, only two locations of contact are present in each groove and the carriers are secured in the grooves of the system having the lower potential by means of an electrically conductive adhesive.

When the insulating carriers are spheres, for example glass beads having accurately identical diameters, the grooves are dimensioned so that each sphere engages its respective grooves in only two points per groove. If the carriers are rods, for example pieces of glass fiber, there are two contact lines per groove. As a result of this, the carriers are positioned very accurately between the rows of apertures in the grooves in the metal plate. The elongate conductors are accurately positioned on the carriers. By providing grooves in the metal plate and the elongate conductors, sharp edges are formed which, as a result of both the high voltage (approximately 2000 Volts) and the small distance (approximately 100 μm) between the elongate conductors and the metal plate, give rise to flash-overs along the carriers. These flashovers can be avoided entirely by fixing the carriers, at least in the grooves of the system having the lower potential, with an electrically conductive adhesive. Surface charge present on the carriers is dissipated to the elongate conductors and/or the metal plate by the adhesive so that flash-overs no longer occur. In addition, the sharp edges are more or less covered and rounded off by the adhesive.

The elongate conductors can be manufactured in a simple manner by connecting two wires together, for example, by spot welding. It is also possible to manufacture the conductors by rolling or etching a groove in a strip. The electrically conductive adhesive may be a solder or an electrically conductive glue. The electrically conductive adhesive is preferably an electrically conductive enamel which is composed of one or more metal oxides and/or one or more metal oxidic compounds having a reacting or non-reacting oxidic binder. The enamel consists of a carrier material of oxidic particles on the surface of which there is a layer of a thickness between 0.5–100 nm of a dried, soluble metal compound which, by heating, is converted into a resistance-determining oxide or an oxidic compound or a layer of the oxide or the oxidic compound itself. The resistance-determining oxide is preferably ruthenium oxide ($RuO_2$). Such electrically conductive enamels are known per se from Netherlands Patent Application No. 7800355 incorporated by reference and not yet laid open to public inspection (U.S. Ser. No. 974,643), in which these enamels are described as resistive materials. The insulating carriers may be manufactured from aluminum oxide or glass. However, the carriers are preferably manufactured from a glass having a resistivity of $\geqq 10^{16}$ ohm cm at 80° C.

A particularly suitable glass for the manufacture of the carriers has approximately the following composition in percent by weight:

19.1: $B_2O_3$
51.7: $B_aO$
10.2: $C_aO$
8.5: $Al_2O_3$
5.2: MgO
4.8: $SiO_2$
0.5: SrO

The advantages of this glass are: (1) a low mobility of ions in the glass, (2) very smooth beads can be manufactured from it, (3) a suitable viscosity characteristic (high viscosity at 550° C.) and low viscosity at 1000°–1200° C., (4) a coefficient of expansion adapted to the material of the color selection means, and (5) stability under electron bombardment.

BRIEF DESCRIPTION OF THE DRAWING

The invention will now be described in greater detail, by way of example, with reference to the accompanying drawing figures, in which.

DESCRIPTION OF THE PREFERRED EMBODIMENTS

Figure 1:
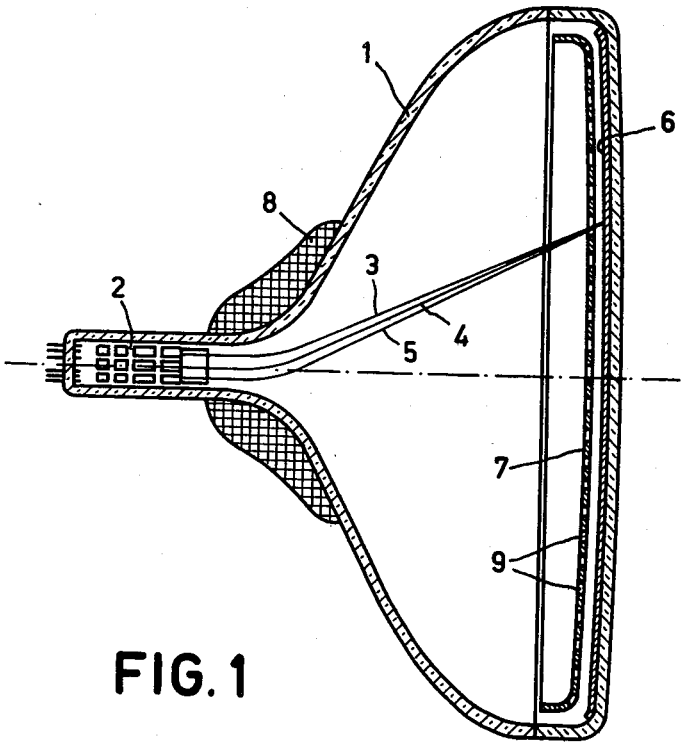
FIG. 1 is a sectional view of a color display tube having color selection means consisting of elongate conductors which are connected to an apertured metal plate.

The tube shown in FIG. 1 comprises a glass envelope 1, means 2 for generating three electron beams 3, 4 and 5, a display screen 6, color selection means 7 and deflection coils 8. The electron beams 3, 4 and 5 are generated in one plane, the plane of the drawing of FIG. 1, and are deflected over the display screen 6 by means of the deflection coils 8. The display screen 6 consists of a large number of phosphor strips luminescing in red, green and blue whose longitudinal direction is perpendicular to the plane of the drawing of FIG. 1. During normal operation of the tube the phosphor strips are vertical and FIG. 1, hence, is a horizontal sectional view of the tube. The color selection means 7 has a large number of apertures 9 which are shown diagrammatically in FIG. 1. The three electron beams 3, 4 and 5 pass through the apertures 9 at a small angle with each other and therefore each impinges only upon phosphor strips of one color. The apertures 9 in the color selection means 7 are thus very accurately positioned relative to the phosphor strips of the display screen 6.

In the generally used shadow mask tube without post-focusing, the electron beams 3, 4 and 5 are not focused as they pass through the apertures 9. U.S. Pat. No. 3,398,309 discloses a display tube in which unipotential lenses for focusing the electron beams are formed in the apertures 9. It has also been suggested to post-focus the beams by means of a potential difference between the color selection means 7 and the display screen 6. In such an arrangement, however, secondary electrons have a very annoying effect.

Figure 2:
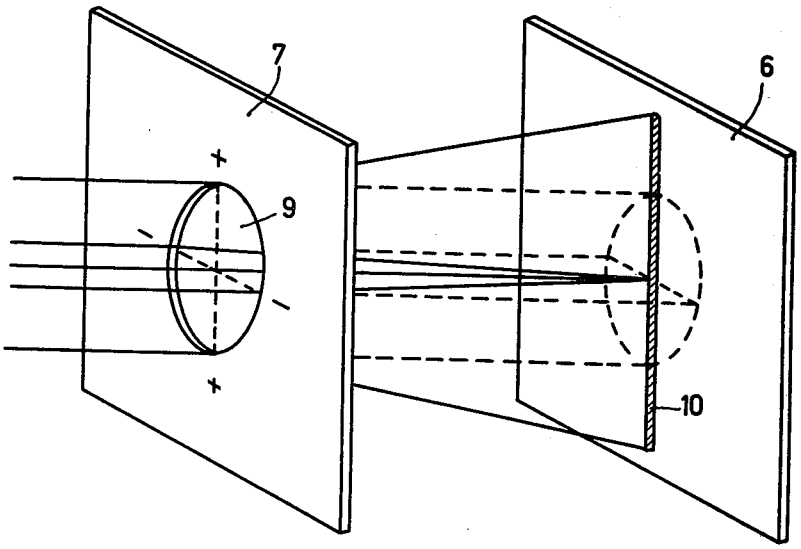
FIG. 2 is a diagramatic view illustrating the principle of the post-focusing effect of a quadrupole lens.

In a color display tube in accordance with the invention, a quadrupole lens is formed in each aperture 9. FIG. 2 illustrates a part of the color selection means 7 and one of the apertures 9. As shown in FIG. 2, the potential variation along the edge of the aperture 9 is alternately +, −, +, − so that a quadrupole field is formed in the aperture. The electron beam which passes through the aperture 9 is focused in the horizontal plane and defocused in the vertical plane so that an electron spot 10 is formed when the display screen is exactly at the horizontal focal point. It is, however, recommended not to focus exactly on the display screen 6 so that a slightly wider electron spot is obtained. The fact that the electron beam passes through the aperture 9 at a small angle has only a minor effect on the focusing so that the color selection of the three electron beams 3, 4 and 5 is effected in a manner quite analogous to that in known shadow mask tubes. As a result of the strong focusing, however, the aperture 9 can be much larger than in known shadow mask tubes so that many more electrons impinge upon the display screen 6 and a brighter and/or sharper picture is obtained. The defocusing in the vertical direction need not be objectionable when phosphor strips are used which are parallel to the longitudinal direction of the spot 10.

Figure 3:
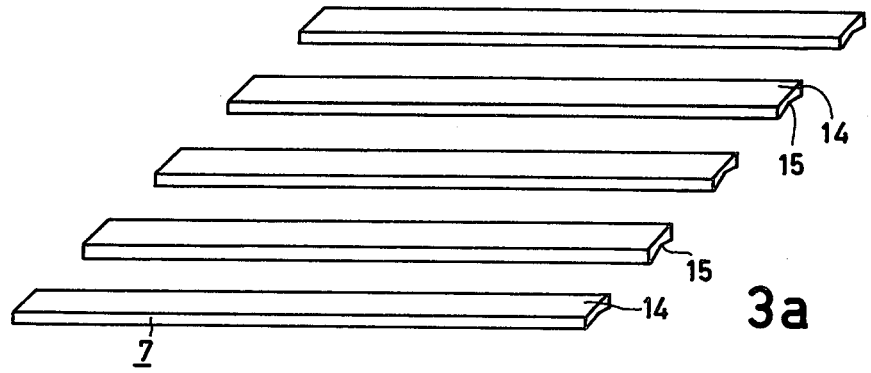
FIG. 3 is an exploded view of an embodiment of color selection means.
Figure 3:
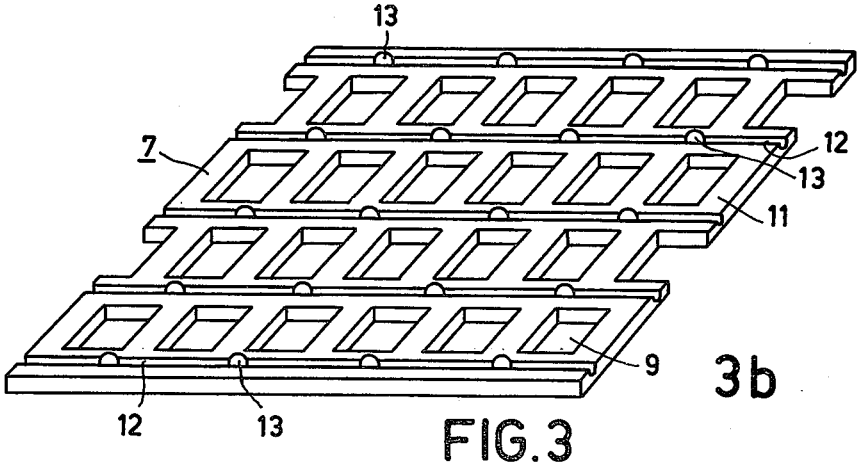
Figure 4:
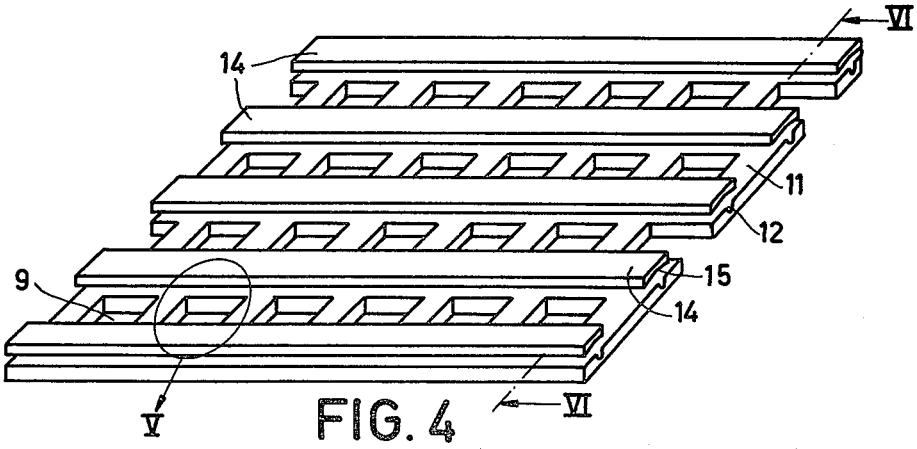
FIG. 4 shows a composed embodiment of color selection means.

FIGS. 3*a* and 3*b* show a perspective exploded view of an embodiment of the color selection means 7 used in a color display tube in accordance with the invention. The selection means comprises an approximately 150 μm thick metal plate 11 having a plurality of substantially parallel spaced rows of apertures 9. V or U-shaped grooves 12 are provided in the spaces between the rows. For example, these grooves may be etched in the plate or be obtained by means of spark erosion and they are, for example, 110 μm wide and 50 μm deep. Glass beads 13 having a diameter of 150 μm are provided in the grooves and constitute the carriers for the elongate conductors 14. The conductors are approximately 220 μm wide and approximately 110 μm thick. A very suitable glass from which the beads can be manufactured with a high resistivity and a number of other good properties has already been described hereinbefore. These elongate conductors 14 are also provided with V or U-shaped grooves 15 so that they are centered unambiguously on the beads 13 as shown in FIG. 4. The beads 13 are fixed in the grooves 12 and 15 by means of a conductive enamel. The conductive enamel should be used at least for the adhesion of the beads to the set of electrodes having the lower potential, in this case the elongate conductors 14. The beads 13 may first be secured to the plate. However, it is also possible to provide the elongate conductors with glass beads at regular distances and then to fix them to the plate.

Figure 5:
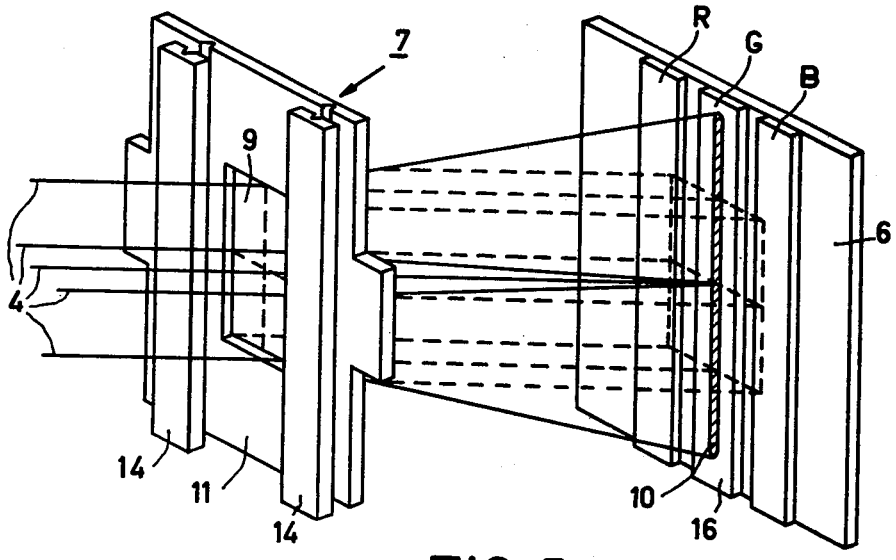
FIG. 5 is an elevational view of a detail of the color selection means shown in FIG. 4.

FIG. 5 is an elevational view of a detail of FIG. 4. The dimensions of the apertures 9 in the center of the color selection means are 475×570 μm and their horizontal and vertical pitches are 775 μm so that the transmissivity of the color selection means is approximately 45%. At the edge of the color selection means there is a departure from these values. At a potential of 25 kV both on the display screen 6 and on the metal plate 11 and a potential of the elongate conductors 14 of 23 kV, the focal distance of the quadrupole lenses is approximately 17 mm with a perpendicular incidence in the center of the display screen. The distance between display screen 6 and the color selection means 7 is 9 mm in the center of the display screen. The electron spots in the center of the display screen are then approximately 210 μm wide and in the corners approximately 160 μm and no focusing is visible on the display screen. The width of the phosphor strips R, G, B is approximately 220 μm. The remainder of the display screen may or may not be provided with a light absorbing material. The display screen 6 and the metal plate 11 are connected electrically and receive their respective voltages of 25 kV from an external voltage source. The voltage of 23 kV which is supplied to the elongate conductors 14 which mutually are electrically interconnected also originates from an external voltage source. FIG. 5 shows the elongate conductors on the side of the plate 11 remote from the display screen 6. Preferably, however, these conductors are provided on the display screen side so that an entirely field-free space is formed between the electron gun and the color selection means. Only a few rays of the central electron beam 4 which forms an electron spot 10 on the phosphor strip 16 are shown in the figure. The apertures 9 in the metal plate 11 are shown to be square. However, it is also possible to use circular or oval apertures or square apertures with rounded corners.

Figure 6:
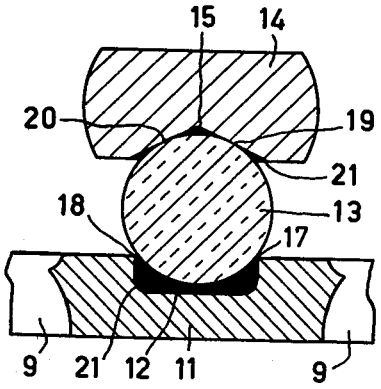
FIG. 6 is a sectional view of a detail of the selection means displayed in FIG. 4.

FIG. 6 is a sectional view of a detail of FIG. 4. The elongate conductors 14 are positioned very accurately between the apertures 9 in the plate 11 because the glass beads 13 are positioned unambiguously in the U-shaped groove 12 and the V-shaped groove 15. This unambiguous positioning takes place in that there are only two points of contact 17 and 18 of each bead in the groove 12 and also only two points of contact 19 and 20 in the respective groove 15 which is provided in each elongate conductor. The glass beads 13 are fixed to the set of electrodes having the lower potential, in this case the elongate conductors 14, by means of an electrically conductive enamel 21. However, this enamel may also be used for fixing the glass beads in the grooves 12 in the plate 11. The conductive enamel prevents flash-overs over the surface of the glass beads and covers the sharp edges of the grooves 12 and 15 near the glass beads 13. Suitable conductive enamels are described as resistive materials in Netherlands Patent Application No. 7800355 which has not yet been laid open to public inspection. These enamels comprise a few tenths percent by weight of ruthenium oxide ($RuO_2$). A suitable enamel is prepared, for example, as follows. A potassium ruthenate solution containing 35 mg of Ru in 50 ml of water is added to a suspension of 1 g of glass powder having a particle size of approximately 1 μm in 25 ml of water and approximately the following composition in percent by weight:

$B_2O_3$: 18.3
ZnO: 11.4
PbO: 36.9
$Al_2O_3$: 2.6
$SiO_2$: 22.1
BaO: 7.1
$NaO_3$: 1.6 and then 10 ml of ethanol. The suspension is thoroughly stirred, filtered, and the filter residue is dried. A paste is made of this material with benzyl benzoate. The paste is converted into the enamel by firing for ⅓ second at 750° C. in air. The sheet resistance of a 12 μm thick enamel layer manufactured from said paste was approximately 0.5–1MΩ. By melting glass beads 13 with such an enamel on the metal plates 11 and/or the elongate conductors 14, no flash-overs occurred between the plate and the conductors having a potential difference of 5000 to 7000 Volts. When a non-conductive enamel is used, for example the above-mentioned enamel without $RuO_2$, a voltage difference of 2000 to 4000 Volts resulted in large problems due to flash-overs.

It is possible to replace the glass beads 13 by pieces of glass fiber. Instead of points of contact 17, 18, 19 and 20, lines of contact are then formed by the pieces of glass fiber with the walls of the grooves.

Figure 7:
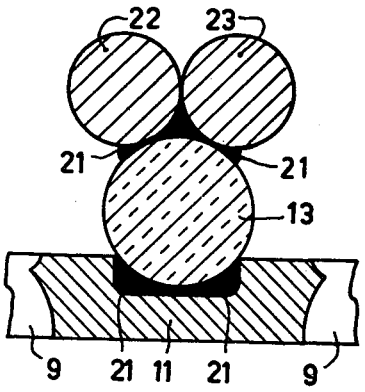
FIG. 7 is a sectional view of a detail of another embodiment of the color selection means.

FIG. 7 is a sectional view of part of another embodiment of color selection means. In this case, the elongage conductors comprise of two parallel wires 22 and 23 welded together. This is a very simple way to obtain elongate conductors with a groove. The wires may be secured together by means of solder or by means of spot welding such as by a laser beam or an electron beam.

A display screen for a tube in accordance with the invention can be manufactured by means of a known exposure method in which the color selection means is displayed on a photosensitive layer on a window portion of the tube. Because of the large transmissivity of the color selection means in accordance with the invention, the exposure method used should be suitable to display the apertures 9 in a strongly narrowed manner. An exposure method suitable for this purpose uses two or more light sources at some distance from each other, as described in German Patent Application No. 2,248,878, laid open to public inspection. Of course, a tube in accordance with the invention is also particularly suitable for so-called electronic exposure in which the sensitive layer on the window portion is "exposed" by means of an electron beam.

What is claimed is:

1. A color display tube comprising, in an evacuated envelope:

means for generating a number of electron beams;

a display screen having a multiplicity of regions luminescing in different colors when struck by beams from said means; and color selection means positioned in the path of said beams between said generating means and said display screen for associating each electron beam with luminescent regions of one color, said selection means including:

a first and a second set of lens electrodes, said first electrode set including a metal plate having a multiplicity of apertures arranged in a plurality of substantially parallel, spaced rows, said second set including a plurality of electrically conductive strips;

a first layer of adhesive material provided on said plate in said spaces between said rows, and a second layer of adhesive material provided on said strips on the sides of the strips facing said plate; and a multiplicity of insulating carriers fixed to said strips and to said plate by said respective adhesive layers so that said strips are spaced from said plate by said carriers, characterized in that said plate has a groove extending longitudinally of said strips in each of said spaces between said parallel rows, and said strips have a longitudinally extending groove in each of said sides facing said plate, a groove in said strip facing a respective groove in said plate, in that each of said carriers engages a groove in said plate at two locations only and the respective groove in said strip at two locations only, and, in that the adhesive material provided on the electrode set intended for application of a lower potential in the normal operation of the tube is an electrically conductive adhesive consisting essentially of particles having a ruthenium oxide layer of a thickness between 0.5 and 100 nanometers, whereby said strips are accurately positioned between said parallel apertured rows and flash-over between said electrode sets in normal operation is reduced.

2. A tube as claimed in claim 1, characterized in that said insulating carriers are spheres.

3. A tube as claimed in claim 1, characterized in that said insulating carriers are rod-shaped.

4. A color display tube as claimed in claims 2 or 3, characterized in that said grooves in said plate are U-shaped and said grooves in said strips are V-shaped.

5. A tube as claimed in claim 4, characterized in that said carriers are formed of a glass having a resistivity of at least $10^{16}$ ohm-cm at 80° C.

6. A tube as claimed in claim 5, characterized in that said carriers consist essentially of a glass having approximately the following composition in percent by weight:

18.5–19.5: $B_2O_3$
50–52: BaO
9.8–10.4: CaO
8.5–9: $Al_2O_3$
5–5.3 : MgO
4.8–6: $SiO_2$
0.5–1.5: SrO

7. A color display tube comprising, in an evacuated envelope:

means for generating a number of electron beams;

a display screen having a multiplicity of regions luminescing in different colors when struck by beams from said means; and color selection means positioned in the path of said beams between said generating means and said display screen for associating each electron beam with luminescent regions of one color, said selection means including:

a first and a second set of lens electrodes, said first electrode set including a metal plate having a multiplicity of apertures arranged in a plurality of substantially parallel, spaced rows, said second set including a plurality of elongate electrodes having sides;

a first layer of adhesive material provided on said plate in said spaces between said rows, and a second layer of adhesive material provided on said elongate electrodes on said sides of said elongate electrodes facing said plate; and a multiplicity of insulating carriers fixed to said elongate electrodes and to said plate by said respective adhesive layers so that said elongate electrodes are spaced from said plate by said carriers, characterized in that each of said elongate electrodes comprises two parallel wires secured together, said plate has a groove extending longitudinally of said elongate electrodes in each of said spaces between said parallel rows, and said elongate electrodes have a longitudinally extending groove in each of said sides facing said plate, a groove in said elongate electrode facing a respective groove in said plate, in that each of said carriers engages a groove in said plate at two locations only and said respective groove in said elongate electrode at two locations only, and in that said adhesive material provided on said electrode set intended for application of a lower potential in the normal operation of the tube is an electrically conductive adhesive, whereby said elongate electrodes are accurately positioned between said parallel apertured rows and flash-over between said electrode sets in normal operation is reduced.

8. A tube as claimed in claim 7, characterized in that said parallel wires are welded together at a number of discrete points.

* * * * *

UNITED STATES PATENT AND TRADEMARK OFFICE

CERTIFICATE OF CORRECTION

PATENT NO. : 4,458,174

DATED : July 3, 1984

INVENTOR(S) : ABRAHAM A. DE KEIJZER

It is certified that error appears in the above-identified patent and that said Letters Patent is hereby corrected as shown below:

IN THE TITLE PAGE:

Change Foreign Application Priority Data to --June 14, 1979--

Signed and Sealed this

*Twenty-first* Day of *January 1986*

[SEAL]

*Attest:*

DONALD J. QUIGG

*Attesting Officer*

*Commissioner of Patents and Trademarks*